US009097043B2

(12) United States Patent
Mitchell et al.

(10) Patent No.: US 9,097,043 B2
(45) Date of Patent: Aug. 4, 2015

(54) MULTI-POINT LOCKING SYSTEM AND ASTRAGAL

(75) Inventors: Michael K. Mitchell, Winston-Salem, NC (US); Andrew Krochmal, Grand Haven, MI (US)

(73) Assignee: Endura Products, Inc., Colfax, NC (US)

( * ) Notice: Subject to any disclaimer, the term of this patent is extended or adjusted under 35 U.S.C. 154(b) by 593 days.

(21) Appl. No.: 12/895,429

(22) Filed: Sep. 30, 2010

(65) Prior Publication Data

US 2011/0018284 A1 Jan. 27, 2011

Related U.S. Application Data

(62) Division of application No. 12/390,976, filed on Feb. 23, 2009, now Pat. No. 8,157,298.

(51) Int. Cl.

| | |
|---|---|
| ***E01F 13/00*** | (2006.01) |
| ***E05C 9/18*** | (2006.01) |
| ***E05B 63/24*** | (2006.01) |
| ***E05C 7/04*** | (2006.01) |
| *E05B 15/02* | (2006.01) |

(52) U.S. Cl.

CPC ..... *E05C 9/185* (2013.01); *E05B 63/242* (2013.01); *E05C 7/04* (2013.01); *E05C 9/1891* (2013.01); *E05B 15/0245* (2013.01); *E05B 2015/027* (2013.01); *E05C 7/045* (2013.01); *E05C 9/1808* (2013.01); *Y10T 70/5372* (2015.04); *Y10T 292/0834* (2015.04); *Y10T 292/0837* (2015.04); *Y10T 292/0895* (2015.04); *Y10T 292/0967* (2015.04); *Y10T 292/1077* (2015.04); *Y10T 292/696* (2015.04)

(58) Field of Classification Search

CPC ..... E05B 15/0245; E05B 2015/027; E05B 63/242

USPC ..... 70/107; 292/341.17; 49/367

See application file for complete search history.

(56) References Cited

U.S. PATENT DOCUMENTS

| | | | | |
|---|---|---|---|---|
| 618,305 | A | 1/1899 | Weaver | |
| 826,943 | A | 6/1906 | Gilleland | |
| 1,077,433 | A | 11/1913 | Schlis | |
| 2,586,900 | A | 2/1952 | Alderman | |
| 2,610,368 | A | 9/1952 | Tschaepe | |
| 3,211,850 | A * | 10/1965 | Toepfer | 200/61.64 |

(Continued)

OTHER PUBLICATIONS

Official Action issued Oct. 28, 2011, (CA App. No. 2,693,833, filed Feb. 19, 2010), pp. 1-3.

(Continued)

*Primary Examiner* — Kristina Fulton
*Assistant Examiner* — Thomas Neubauer
(74) *Attorney, Agent, or Firm* — Womble Carlyle Sandridge & Rice, LLP

(57) ABSTRACT

A multipoint locking system includes a body having an upper aperture and a lower aperture therein. An upper latch pawl is disposed in the upper aperture and is pivotable about a first vertical axis between a first retracted position and a first extended position. A lower latch pawl is disposed in the lower aperture and is pivotable about a second vertical axis between a second retracted position and a second extended position. At least one actuator is configured to move the upper and lower latch pawls between their retracted and extended positions. The body can be an astragal, a vertical frame member, or the like.

10 Claims, 16 Drawing Sheets

(56) References Cited

U.S. PATENT DOCUMENTS

| | | | | | |
|---|---|---|---|---|---|
| 3,638,984 | A | | 2/1972 | Davidson | |
| 3,649,060 | A | | 3/1972 | Ruff | |
| 3,656,788 | A | | 4/1972 | Emery | |
| 3,788,679 | A | | 1/1974 | Banham | |
| 3,788,687 | A | | 1/1974 | Zawadzki | |
| 4,428,153 | A | * | 1/1984 | Klinger et al. | 49/366 |
| 4,429,493 | A | | 2/1984 | St. Aubin | |
| 4,644,696 | A | | 2/1987 | Bursk | |
| 4,999,950 | A | | 3/1991 | Beske | |
| 5,197,771 | A | | 3/1993 | Kaup | |
| 5,290,077 | A | | 3/1994 | Fleming | |
| 5,328,217 | A | * | 7/1994 | Sanders | 292/341.19 |
| 5,350,207 | A | * | 9/1994 | Sanders | 292/335 |
| 5,524,942 | A | | 6/1996 | Fleming | |
| 5,590,919 | A | | 1/1997 | Germano | |
| 5,782,114 | A | | 7/1998 | Zeus | |
| 5,791,700 | A | | 8/1998 | Biro | |
| 5,857,291 | A | | 1/1999 | Headrick | |
| 5,906,403 | A | | 5/1999 | Bestler | |
| 6,009,732 | A | | 1/2000 | Haeck | |
| 6,131,966 | A | * | 10/2000 | Hensley et al. | 292/139 |
| 6,282,929 | B1 | | 9/2001 | Eller et al. | |
| 6,457,751 | B1 | | 10/2002 | Hartman | |
| 6,491,326 | B1 | | 12/2002 | Massey et al. | |
| 6,874,830 | B2 | | 4/2005 | Bashford | |
| 6,966,585 | B2 | | 11/2005 | Egi et al. | |
| 6,971,686 | B2 | | 12/2005 | Becken | |
| 7,036,854 | B1 | | 5/2006 | Lai | |
| 7,144,053 | B2 | | 12/2006 | Bashford | |
| 7,267,379 | B2 | | 9/2007 | Rusiana | |
| 7,641,244 | B2 | | 1/2010 | Lin | |
| 7,669,902 | B2 | | 3/2010 | Orbeta | |
| 7,722,097 | B2 | | 5/2010 | Schnarr et al. | |
| 7,735,882 | B2 | * | 6/2010 | Abdollahzadeh et al. | 292/44 |
| 7,752,875 | B2 | | 7/2010 | Constantinou et al. | |
| 7,900,981 | B2 | | 3/2011 | Hirschoff | |
| 7,942,458 | B2 | | 5/2011 | Patterson | |
| 2005/0120631 | A1 | * | 6/2005 | Sanders | 49/367 |
| 2006/0145488 | A1 | | 7/2006 | Wittke et al. | |
| 2007/0001469 | A1 | | 1/2007 | Balbo Di Vinadio | |
| 2007/0029812 | A1 | | 2/2007 | Monts de Oca | |
| 2007/0283629 | A1 | | 12/2007 | Phipps | |
| 2008/0087052 | A1 | | 4/2008 | Abdollahzadeh et al. | |

OTHER PUBLICATIONS

Official Action issued Oct. 17, 2011, (U.S. Appl. No. 12/895,432, filed Sep. 30, 2010), pp. 1-8.

* cited by examiner

MULTI-POINT LOCKING SYSTEM AND ASTRAGAL

RELATED APPLICATIONS

This application is a divisional of U.S. application Ser. No. 12/390,976 filed Feb. 23, 2009, the content of which is incorporated by reference in its entirety.

FIELD OF THE INVENTION

The invention generally relates to locks, and more particularly relates to a multi-point locking system for securing a swinging door panel in a closed position and an astragal incorporating such a multi-point locking system.

BACKGROUND

Exterior entryways of modern homes and buildings often include cooperating pairs of swinging doors commonly referred to as double doors or French doors. Such doors include an inactive swinging door panel, and an adjacent active swinging door panel. The sets of doors may swing inwardly into the structure (so-called "inswing" doors), or may swing outwardly from the structure (so-called "outswing" doors). The inactive door panel typically includes a generally T-shaped astragal mounted along the entire extent of its non-hinged vertical edge. As used herein, the term "astragal" generally means an elongated member attached to and substantially coextensive with the non-hinged vertical edge of one of a pair of swinging double doors. In a conventional arrangement, an astragal is mounted along the non-hinged vertical edge of an inactive door panel, and provides a stop against which a cooperating active door panel strikes when both door panels are closed.

In its simplest form, an astragal consists of a single length of wooden molding attached along the non-hinged edge of an inactive door panel by screws, nails, or the like. Such simple astragals serve no role in fixing an inactive swinging door panel in a closed position in a doorway. Instead, special unrelated locking hardware is required for that purpose. Such locking hardware can be internally mounted within specially formed pockets or recesses within the body of the inactive door panel. Such pockets or recesses must be specially formed in the edge of the door by routing, milling, chiseling, or the like. The locking hardware typically includes independently operable top and bottom shoot bolts which are received in specially drilled bores in the top and bottom of the inactive door panel proximate to the door panel's non-hinged vertical edge. When extended, the top and bottom shoot bolts selectively engage aligned pockets or holes in the top jamb and doorsill of the associated doorway, thereby fixing the inactive door panel in a closed position. When retracted, the top and bottom shoot bolts permit the inactive door panel to swing open. Both the top and bottom shoot bolts typically are actuated by either a slide or lever mechanism installed along the non-hinged vertical edge of the inactive door panel.

Some modern astragals for inactive door panels include vertically moveable top and bottom shoot bolts disposed in a flush-mounted elongated housing. One such astragal is described in U.S. Pat. No. 6,491,326 to Endura Products, Inc., for example. Like the simple astragal described above, the housing of such locking astragals is surface-mounted along the non-hinged vertical edge of an inactive door panel, and provides a stop for a cooperating active door panel. When the inactive panel is closed and the top and bottom shoot bolts are vertically extended, the top and bottom shoot bolts are respectively received in pockets or holes in the top jamb and doorsill of the associated doorway, thereby fixing the inactive panel in a closed position. In order to permit the inactive panel to be opened, the top and bottom shoot bolts can be selectively retracted from their associated pockets or holes in the doorframe. The top and bottom shoot bolts can be vertically extended and retracted by a lever or slide actuating mechanism disposed within the housing. Unlike shoot bolt mechanisms that must be internally installed within specially formed recesses or pockets in a door, such locking astragals can be removably installed relatively easily on a substantially planar external surface or surfaces of an inactive door panel.

The active door panel of a pair of double swinging doors commonly includes conventional locking door hardware. Such hardware may include a conventional door handle lockset like that used for a single swinging door. In such an arrangement, the latch bolt of the lockset is received in an aligned strike plate recess milled in the non-hinged vertical edge of the cooperating inactive door panel, or in an astragal attached along the non-hinged vertical edge of the cooperating inactive door panel. For added security, a conventional deadbolt also may be installed in the active door panel. Like the lockset bolt described above, the bolt of the deadbolt is received in an aligned strike plate recess milled in the non-hinged vertical edge of the cooperating inactive door panel or an associated astragal.

For further additional security and strength, multi-point locking systems are known that can be specially installed within the non-hinged vertical edge of an active door panel. In such an arrangement, a lock case is recessed within a specially milled lock case pocket in the non-hinged vertical edge of an active swinging door panel. The lock case encloses an actuating mechanism. Upper and lower actuating rods or bars upwardly and downwardly extend from the lock case to upper and lower latch bolt housings, respectively. The independent upper and lower latch bolt housings contain latch bolt mechanisms, and are recessed within specially formed latch bolt pockets or recesses in the non-hinged vertical edge of the active swinging door panel. Operation of the actuating mechanism causes selective vertical movement of the actuating rods or bars, which in turn cause a latch bolt to laterally extend and outwardly protrude from each latch bolt housing. When extended, each latch bolt engages a mating opening or recess in an adjacent frame member, inactive door panel, astragal, or the like, thereby securing the active door panel in a closed position. An elongated faceplate may be attached to the edge face of the vertical edge of the door to conceal portions of the mechanism that are recessed within the edge of the door. Preferably, the upper latch bolt is positioned proximate to a top of the door's vertical edge, and the lower latch bolt is positioned proximate to a bottom of the door's edge. Similar recessed devices are known that include vertically extending latch bolts. Multi-point latching systems of this type are known to provide a stronger, more secure closure than single-point locks positioned at or near the mid-height of a door. Unfortunately, such multi-point locks are difficult and costly to install due to the extensive preparation of the door edges required to assemble the recessed portions of the locking mechanisms in the doors.

Accordingly, there is a need for a surface-mounted multi-point locking system for the non-hinged vertical edge of an inactive swinging panel that includes multiple latches for securely engaging a cooperating swinging active door panel at multiple points along the edge of the active door. In addition, there is a need for such a surface-mounting locking device for an inactive panel of a pair of double swinging panels that also fixes the inactive panel within a frame. Furthermore, there is a need for a multi-point locking device that provides the added security of known recessed multi-point door locking systems, but does not require expensive custom preparation of a door's edge in order to install the device. There also is a need for a multipoint locking system for single swinging door panels.

SUMMARY

In one embodiment, an astragal can include a first shoot bolt that is movable between a retracted position and an extended position. A seal block can be movable between a non-sealing position and a sealing position and can include a bolt passage therethrough. The first shoot bolt can be slidably disposed in the passage. An actuator can be configured to selectively move the first shoot bolt between the retracted position and the extended position and to selectively move the seal block between the non-sealing position and the sealing position. A first spring can be configured to bias the first bolt toward the extended position when the first shoot bolt is in the extended position. A second spring can be configured to bias the seal block toward the sealing position when the seal block is in the sealing position. A first force exerted by the first spring on the first shoot bolt can be greatest when the first bolt is in the extended position, and a second force exerted by the second spring on the seal block can be greatest when the seal block is in the sealing position.

In another embodiment, a multipoint locking system can include a body having an upper aperture and a lower aperture therein. An upper latch pawl can be disposed in the upper aperture and can be pivotable about a first vertical axis between a first retracted position and a first extended position. A lower latch pawl can be disposed in the lower aperture and can be pivotable about a second vertical axis between a second retracted position and a second extended position. At least one actuator can be configured to move the upper and lower latch pawls between their retracted and extended positions.

In a further embodiment, a latch keeper for use with a locking system having a cooperating latch pawl can include a base having an aperture therein. A keeper pawl can be pivotally disposed within the aperture and can be movable between an extended position and a retracted position. The keeper pawl can be configured for engagement with a catch portion of the cooperating latch pawl when the latch pawl is in an extended position.

In an additional embodiment, an astragal can include an elongated housing having an upper end and a lower end. The housing can be configured for external attachment along a non-hinged vertical edge of a swinging door panel. An upper shoot bolt can be slidably disposed in the housing proximate to the upper end, and can be movable between a retracted position and an extended position. A lower shoot bolt can be slidably disposed in the housing proximate to the lower end, and can be movable between a recessed position and a deployed position. An actuator can include a lever that is selectively movable between an unlocked position and a locked position, and can be operatively coupled to both the upper shoot bolt and the lower shoot bolt. When the lever is in the unlocked position, the upper shoot bolt can be in its retracted position and the lower shoot bolt can be in its recessed position, and when the lever is in the locked position, the upper shoot bolt can be in its extended position and the lower shoot bolt can be in its deployed position.

In another embodiment, a multipoint locking system can be provided for a door panel having a non-hinged vertical edge and that is pivotally disposed within a doorframe having a vertical frame member that is proximate to the non-hinged vertical edge when the door panel is in a closed position in the doorframe. The locking system can include an upper latch pawl that is disposed in an upper aperture in the vertical frame member and that is pivotable about a first vertical axis between a first retracted position and a first extended position. The locking system also can include a lower latch pawl that is disposed in a lower aperture in the vertical frame member and that is pivotable about a second vertical axis between a second retracted position and a second extended position. An actuator can be operatively coupled to both the upper and lower latch pawls and can be configured to substantially simultaneously move the upper and lower latch pawls between their retracted and extended positions.

DESCRIPTION

Figure 1:
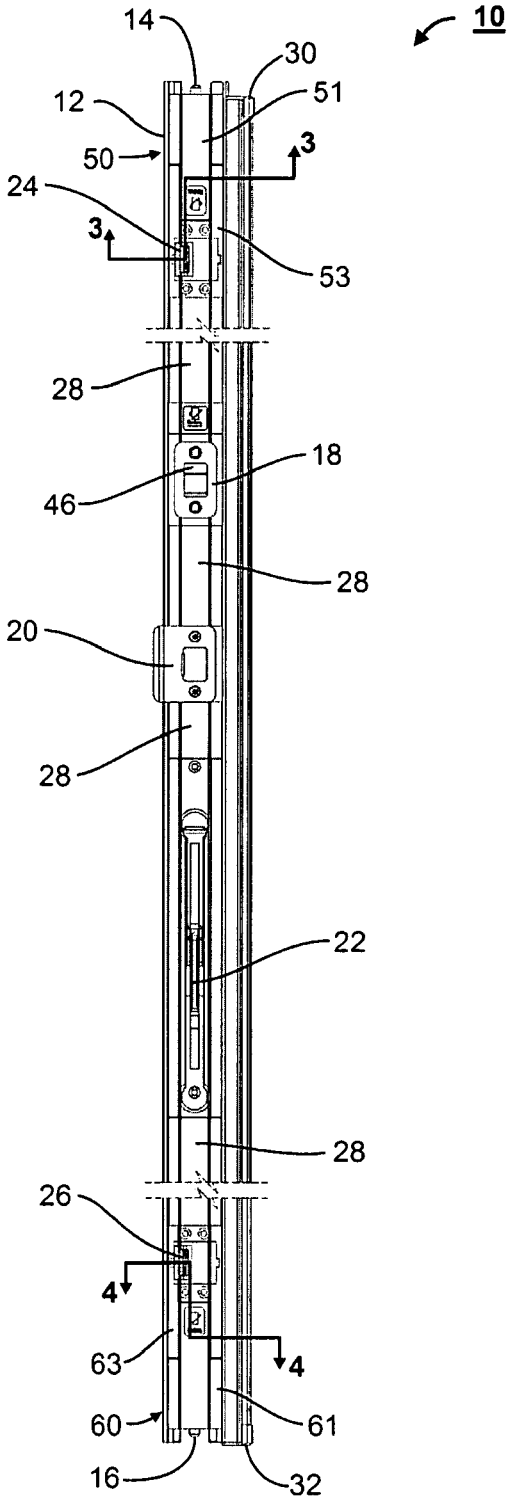
FIG. 1 is an elevation view of one embodiment of a multi-point locking astragal assembly according to the invention.

One embodiment of a surface-mounting multi-point locking astragal 10 for an inactive door panel is shown in FIGS. 1-4. As shown in FIG. 1, the astragal 10 can include an elongated body 12 having an upper shoot bolt 14 disposed at an upper end and a lower shoot bolt 16 disposed at a lower end. A shoot bolt actuator 22 can be provided for selectively extending and retracting the shoot bolts 14, 16. In the embodiment shown in the drawings, the shoot bolt actuator 22 is a lever-type actuator of a type known in the art. A strike plate 20 can be positioned along the astragal 10 to receive a door knob latch bolt from a cooperating active door panel (not shown). The astragal 10 can also include a dead bolt plate 18 for receiving a deadbolt from a cooperating active door panel. A plurality of body trim plates 28 can be provided between the various components. The astragal 10 also can include an upper multi-point latch pawl 24 positioned along an upper portion of the body 12 and a lower multi-point latch pawl 26 positioned along a lower portion of the body 12.

Figure 2:
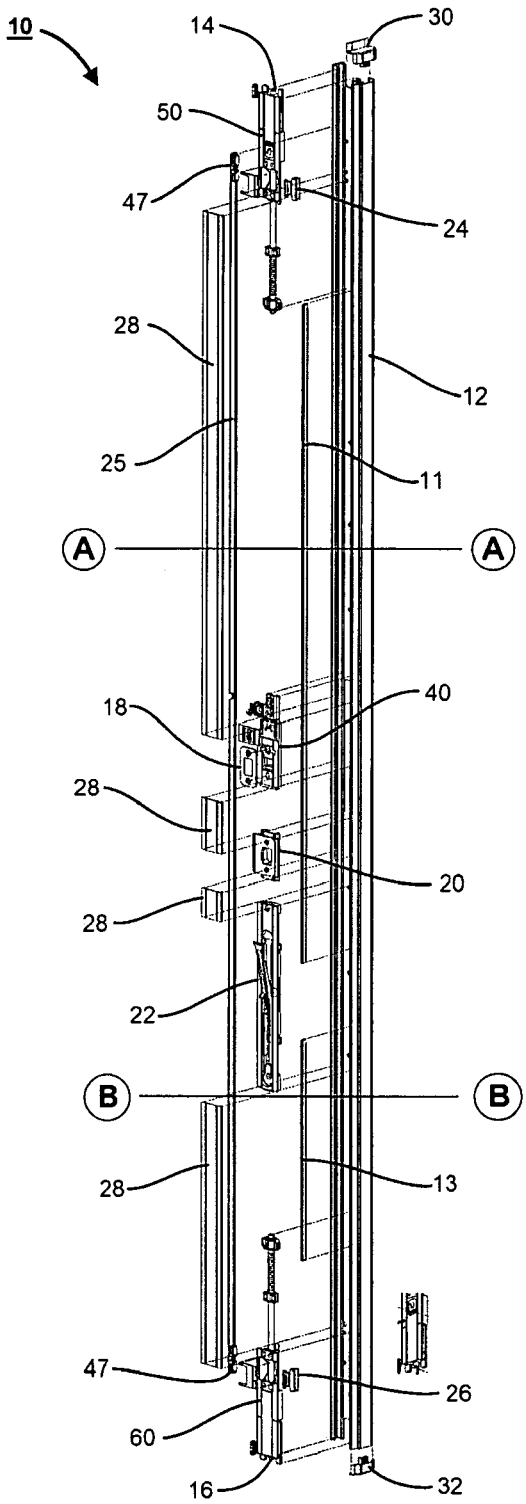
FIG. 2 is an exploded view of the multi-point locking astragal assembly shown in FIG. 1.
Figure 2A:
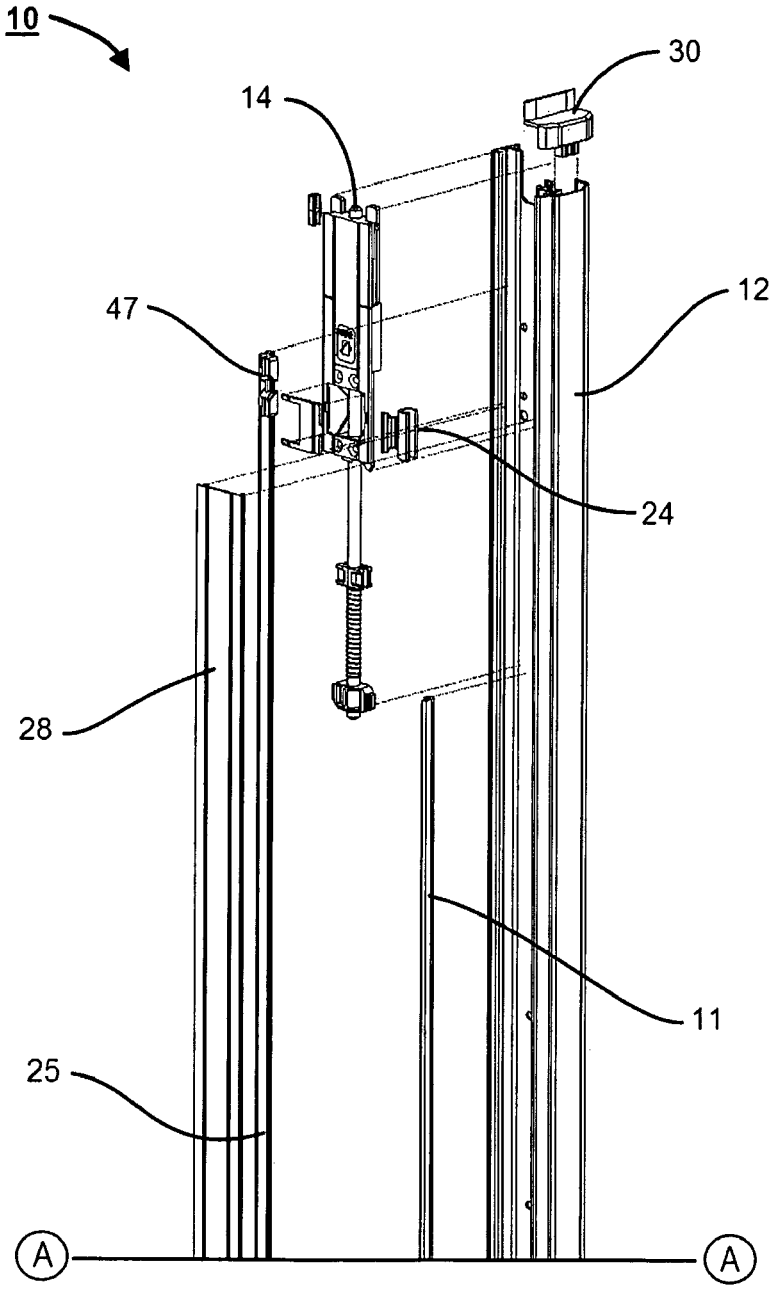
FIG. 2A is a detail view of an upper portion of the exploded assembly shown in FIG. 2.
Figure 2B:
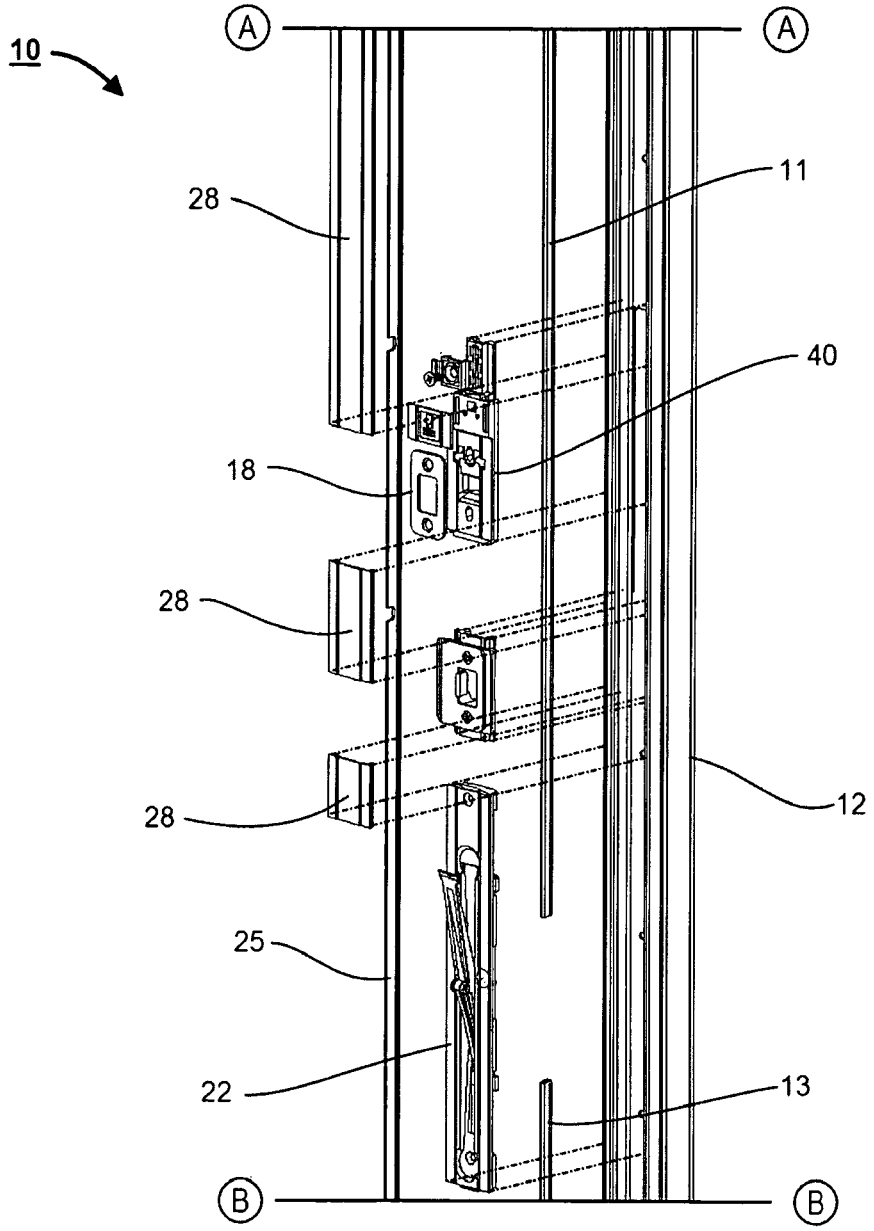
FIG. 2B is a detail view of a middle portion of the exploded assembly shown in FIG. 2.
Figure 2C:
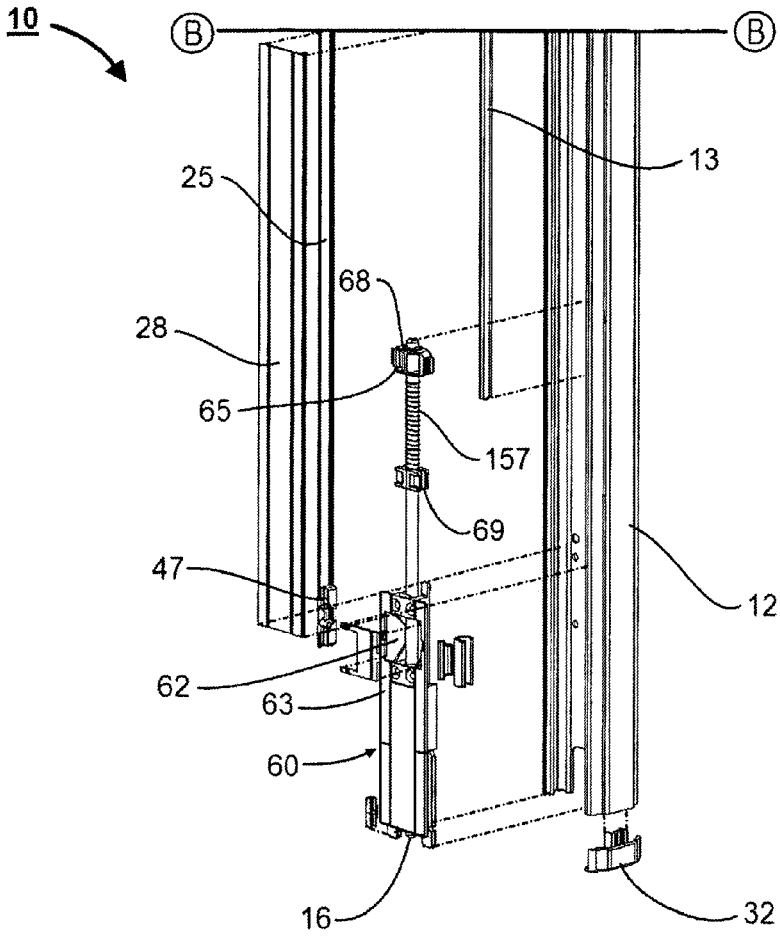
FIG. 2C a detail view of a lower portion of the exploded assembly shown in FIG. 2.

Further details of the astragal 10 can be seen in the exploded views shown in FIGS. 2, 2A and 2B. An upper trim cap 30 can be provided on the upper end of the body 12, and a lower trim cap 32 can be provided on the lower end of the body 12. The trim caps 30, 32 provide the ends of the astragal 10 with a finished appearance. As shown in FIGS. 2 and 2A, the upper shoot bolt 14 can be disposed within an upper shoot bolt assembly 50. Similarly, the lower shoot bolt 16 can be disposed within a lower shoot bolt assembly 60. As shown in FIG. 2, the upper and lower shoot bolt assemblies 50, 60 can be respectively connected to the shoot bolt actuator 22 by upper and lower shoot bolt actuator links 11, 13. As shown in FIGS. 2 and 2B, a multi-point latch actuator assembly 40 can be disposed behind the dead bolt plate 18. One or more push rods 25 can operably connect the upper and lower latch pawls 24, 26 to the multi-point latch actuator 40. As described below, the multi-point latch actuator 40 can be configured to simultaneously extend the upper and lower multi-point latch pawls 24, 26 when a deadbolt from a cooperating swinging door panel is received in the dead bolt plate 14 and the actuator 40.

Figure 3:
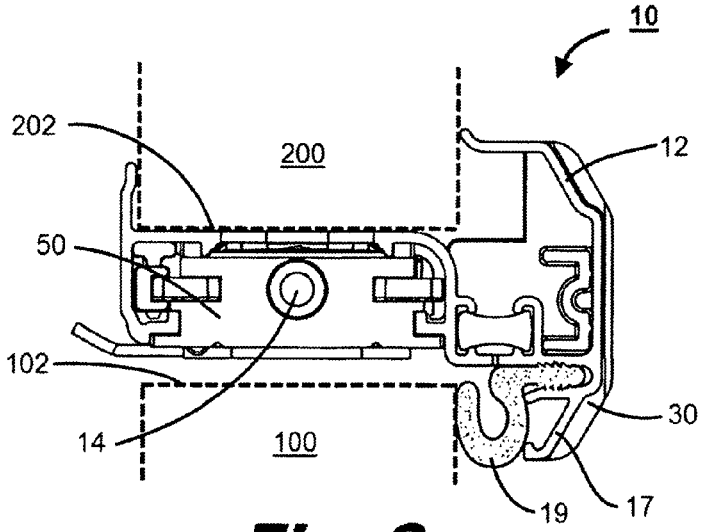
FIG. 3 is a cross sectional view of an upper portion of the multi-point locking astragal assembly taken along offset section line 3-3 in FIG. 1.
Figure 4:
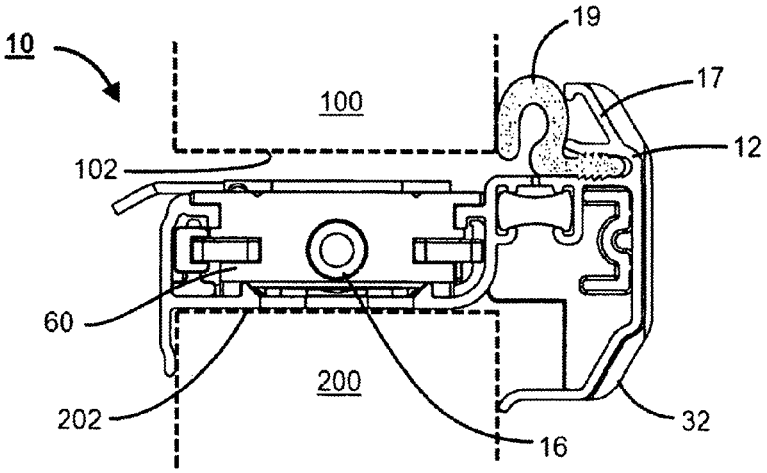
FIG. 4 is a cross sectional view of a lower portion of the multi-point locking astragal assembly taken along offset section line 4-4 in FIG. 1.

FIGS. 3 and 4 show a cross-sectional profile of one embodiment of an astragal 10 having a body 12. The body 12 can be configured for attachment along a non-hinged vertical edge 202 of an inactive door panel 200. An outwardly extending edge portion 17 of the body 12 provides a stop for a cooperating active door panel 100. A resilient seal 19 can be attached along the edge portion 17 to provide a weather seal between the astragal 10 and an associated swinging active panel 100.

Figure 5:
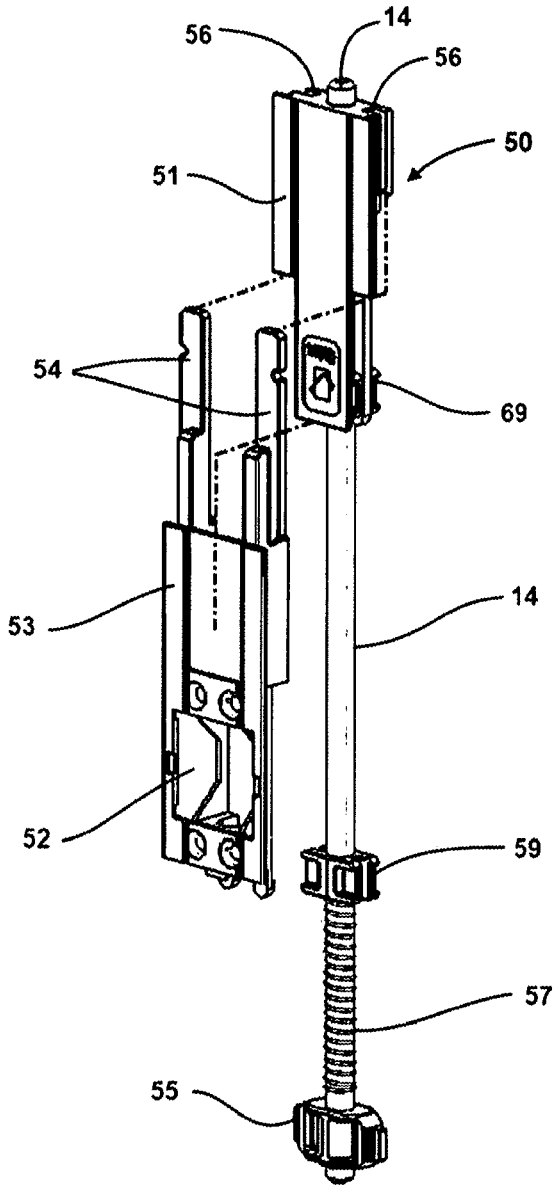
FIG. 5 is an exploded perspective view of one embodiment of an upper shoot bolt assembly.
Figures 6A, 6B, 6C, 6D:
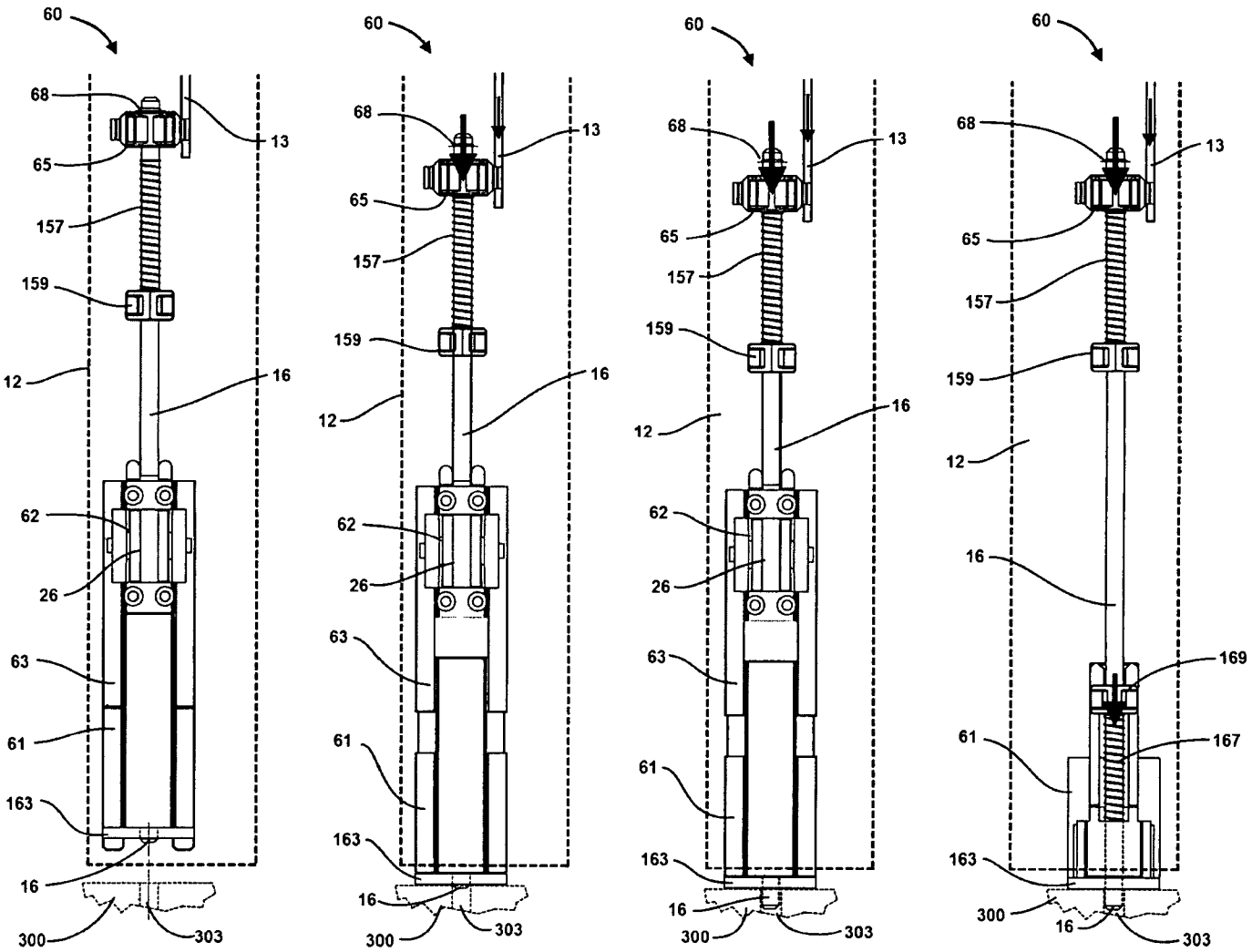
FIG. 6A is an elevation view of a lower shoot bolt assembly with its shoot bolt in a retracted position.
FIG. 6B is an elevation view of a lower shoot bolt assembly with its shoot bolt in a partially extended position.
FIG. 6C is an elevation view of a lower shoot bolt assembly with its shoot bolt in a fully extended position.
FIG. 6D is an elevation view of the opposite side of the lower shoot bolt assembly shown in FIG. 6C.

One embodiment of an upper shoot bolt assembly 50 is shown in FIG. 5. In this embodiment, the upper shoot bolt 14 can be slidably received in a sliding upper seal block 51 having opposed grooves 56. The opposed grooves 56 can each receive a track 54 on an upper guide 53 when the upper seal block 51 is slidably engaged with the upper guide 53. The upper guide 53 can be configured to be mounted within the astragal body 12 in a stationary position, and can include a latch opening 52. As shown in FIG. 5, an upper spring stop 69 and a lower spring stop 59 can be attached to the upper shoot bolt 14. A push sleeve 55 can be slidably received on a lower end of the upper shoot bolt 14, and a first spring 57 can be disposed between the lower spring stop 59 and the push sleeve 55. Similarly and as shown in FIGS. 6A-6D, the lower shoot bolt assembly 60 can include a lower guide 63 with a latch opening 62 and a sliding lower seal block 61. A lower spring stop 169 and an upper spring stop 159 can be attached to the lower shoot bolt 14. A push sleeve 65 can be slidably received on an upper end of the lower shoot bolt 16, and a first spring 157 can be disposed between the upper spring stop 159 and the push sleeve 65. As shown in FIGS. 2A and 6D, a second spring 167 can be disposed between the upper spring stop 169 and the lower seal block 61. A retainer ring 68 on the upper end of the lower shoot bolt 16 can retain the push sleeve 65 on the lower shoot bolt 16. A resilient seal 163 can be attached to a lower end of the lower seal block 61. The upper shoot bolt assembly 50 and the lower shoot bolt assembly 60 can be substantially identical to each other or mirror images of each other.

Operation of a lower shoot bolt assembly 60 is illustrated in FIGS. 6A-6D. Operation of the upper shoot bolt assembly 50 can be substantially the same. In FIGS. 6A-6D, the resilient seal 163 is disposed on the bottom end of the seal block 61 and surrounds the lower shoot bolt 16. The seal 163 can be constructed of a resilient material such as foam rubber, or the like. In FIG. 6A, the lower shoot bolt 13 and seal block 61 are shown in their retracted positions relative to a guide 63 and body 12. In this retracted position, the lower end of the lower shoot bolt 16 does not extend a substantial distance below the lower end of the body 12, and is not engaged in an aligned bolt cup 303 in an underlying sill 300 of a door frame. As the shoot bolt actuator 22 (shown in FIGS. 1, 2 and 2B) is manually actuated, the lower actuator link 13 pushes downward on the push sleeve 65, and causes the push sleeve 65 to translate downward relative to the guide 63 and body 12. The downward translating push sleeve 65 pushes against a first spring 157 which pushes against an upper spring stop 69, thus causing the upper spring stop 69 and shoot bolt 16 to move downward. As the shoot bolt 16 moves downward, the lower spring stop 169 pushes on the second spring 167 which pushes on the lower seal block 61, thus causing downward translation of the seal block 61. As shown in FIG. 6B, downward translation of the seal block 61 continues until the seal 163 contacts the underlying sill 300. In this position, the lower end of the lower shoot bolt 16 is proximate to the aligned bolt cup 303 in the sill 300.

As shown in FIGS. 6C and 6D, as the push sleeve 65 and shoot bolt 16 continue to translate downward, the lower end of the shoot bolt 16 extends past the seal 163 and is received within the aligned bolt cup 303 in the sill 300. At this point, the first spring 157 is partially compressed, and biases the shoot bolt 16 toward its locked position. In addition, further downward movement of the second push fitting 69 acts to compress the second spring 167 against the slider 61, thereby biasing the slider 61 and seal 163 against the sill 300. The preloaded seal 163 can prevent moisture from entering any gap that exists beneath a lower portion of an associated active door panel 100 and a lower end of the astragal 10. Both the first and second springs 157, 167 are at their minimum compressed lengths and exert maximum forces when the shoot bolts 14, 16 and slider 61 are fully extended. The springs 157, 167 permit the length of travel of the seal block 61 and shoot bolt 13 to vary in order to accommodate differences in configuration between installations. Reversing the shoot bolt actuator 22 causes the lower shoot bolt 16 and lower seal block 61 to disengage from the sill 300 and bolt cup 303.

The upper shoot bolt assembly 50 can be simultaneously actuated by the shoot bolt actuator 22 and upper actuator link 11 (see FIG. 2), and can operate substantially identically to the lower shoot bolt assembly 60 described above. The upper shoot bolt 14 can engage an aligned opening in a bolt plate affixed to an overlying header (not shown), for example. When the upper and lower shoot bolts 14, 16 are extended and are engaged in respective openings in a doorframe, the bolts 14, 16 fix an inactive door panel 200 to which the astragal 10 is attached in a closed position within the doorframe.

Figure 8:
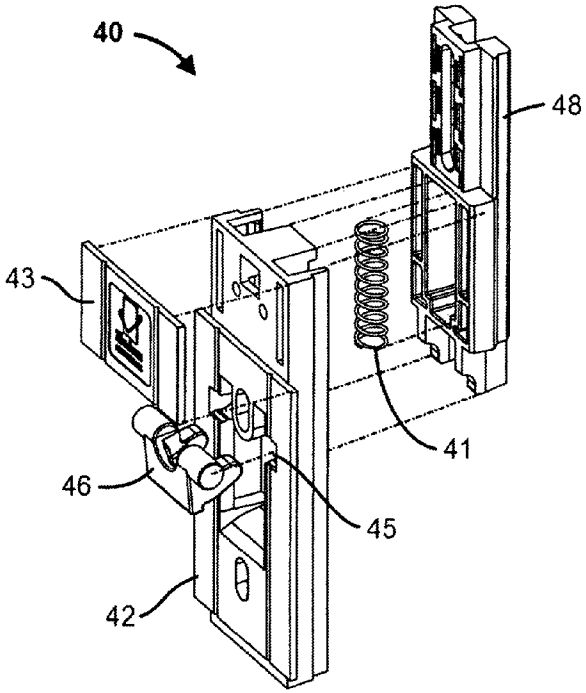
FIG. 8 is an exploded perspective view of the multi-point latch actuator assembly shown in FIG. 7.
Figure 7:
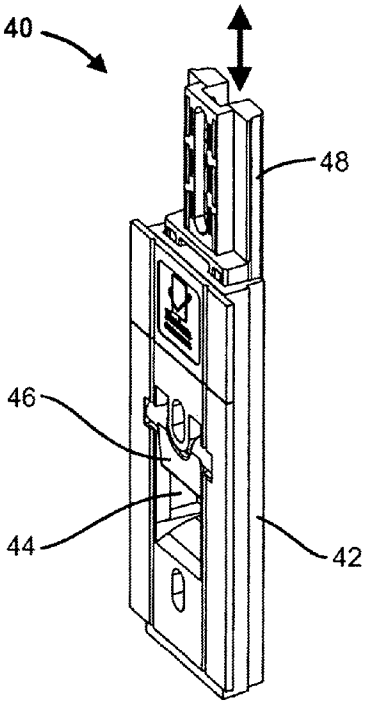
FIG. 7 is a perspective view of one embodiment of a multi-point latch actuator assembly.
Figure 9B:
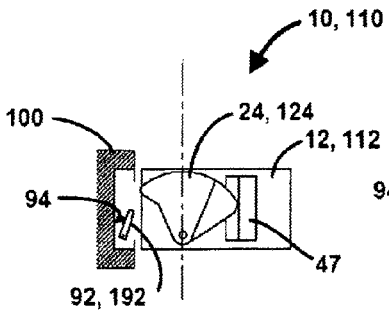
FIG. 9B is a top plan view of the multi-point latch mechanism shown in FIG. 9A.

FIGS. 7 and 8 show one embodiment of a multi-point latch actuator assembly 40 for use in a multi-point locking astragal 10. In this embodiment, the actuator assembly 40 can include a base 42 and a cam follower 48. The cam follower 48 can be slidably disposed on or within the base 42. An actuator spring 41 can be disposed between the base 42 and the cam follower 48. The base 42 can include an opening 44 configured to receive an aligned deadbolt from a cooperating active door panel (not shown). A cam 46 can be pivotally connected to the base 42, such as in slots 45, and can be at least partially disposed within the opening 44. Rotation of the cam 46 causes sliding movement of the cam follower 48 on the base 42, and compression of the actuator spring 41. The cam 46 can be configured and positioned in the opening 44 such that when a deadbolt is received in the opening 44, the deadbolt forces the cam 46 to upwardly rotate, which causes vertical sliding movement of the cam follower 48. The cam follower 48 is operably connected to the push rod 25 shown in FIG. 2B. Accordingly, insertion of a deadbolt into the opening 44 results in associated vertical movement of both the cam follower 48 and the push rod 25.

Figure 9A:
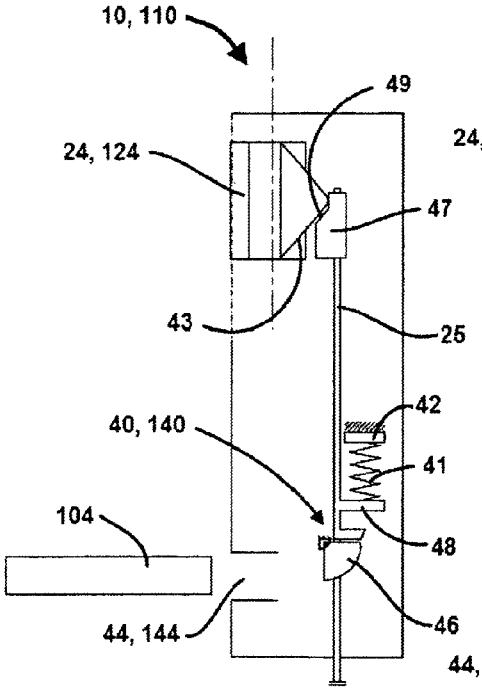
FIG. 9A is a schematic elevation view of one embodiment of a multi-point latch mechanism in an unlocked position.

Operation of the multi-point latches 24, 26 is illustrated schematically in FIGS. 9A-10B. In FIGS. 9A and 9B, the upper multi-point latch 24 is pivotally disposed in an astragal housing 12. As described above, the upper and lower latches 24, 26 can be pivotally mounted within openings 52 in the shoot bolt actuator assemblies 50, 60 of an astragal 10. In the embodiment shown, the latch 24 pivots about a vertical axis that is parallel to the longitudinal axis of the astragal 10. An actuator cam 46 is pivotally disposed within an opening 44 that aligns with a deadbolt 104 in a cooperating active door panel. A cam follower 48 is movably disposed proximate to the cam 46, and is operably connected to a push rod 25. A spring 41 biases the cam follower 48 in a downward position. A latch actuation member 47 on an upper end of the push rod 25 is positioned proximate to the latch 24. As shown in FIG. 9B, when the latch 24 is in a retracted position, substantially no portion of the latch 24 outwardly extends from the astragal 10, and the latch 24 is not engaged with an adjacent keeper pawl 92 of a keeper 90 on a cooperating active door panel 100.

Figure 10B:
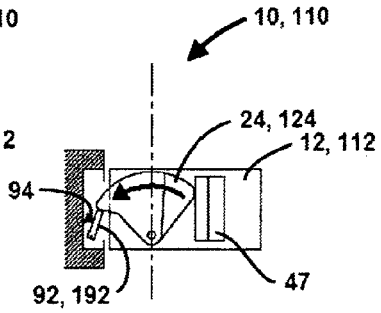
FIG. 10B is a top plan view of the multi-point latch mechanism shown in FIG. 10A.
Figure 10A:
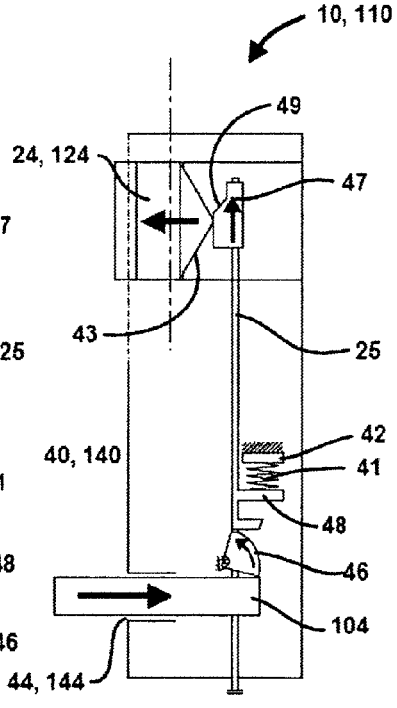
FIG. 10A is a schematic diagram of the multi-point latch mechanism shown FIGS. 9A and 9B showing the mechanism in a locked position.

As shown in FIGS. 10A and 10B, when the deadbolt 104 is received in the opening 44 and displaces the cam 46, the cam follower 48, push rod 25 and latch actuation member 47 are pushed upward by the cam 46. Upward movement of the latch actuation member 47 causes rotation of the latch pawl 24, thus causing the latch pawl 24 to outwardly extend from the astragal 10. When outwardly extended, the latch pawl 24 engages the keeper pawl 92 of the aligned keeper 90 on the adjacent active door panel 100, and blocks movement of the active panel 100 relative to the astragal 10. The lower multi-point latch 26 shown in FIG. 1 can operate similarly to and simultaneously with the upper latch 24. Accordingly, when a deadbolt 104 of a cooperating active door panel 100 is received in the astragal 10, the active door panel 100 is engaged with the astragal 10 at multiple points along its length, including at the deadbolt 104, at the upper latch 24, and at the lower latch 26. Conversely, when the deadbolt 104 is extracted from the opening 44, the spring 41 causes the cam follower 48, push rod 25 and latch actuation member 47, latch 24 and cam 46 to return to the unlocked positions shown in FIGS. 9A and 9B.

Figure 11B:
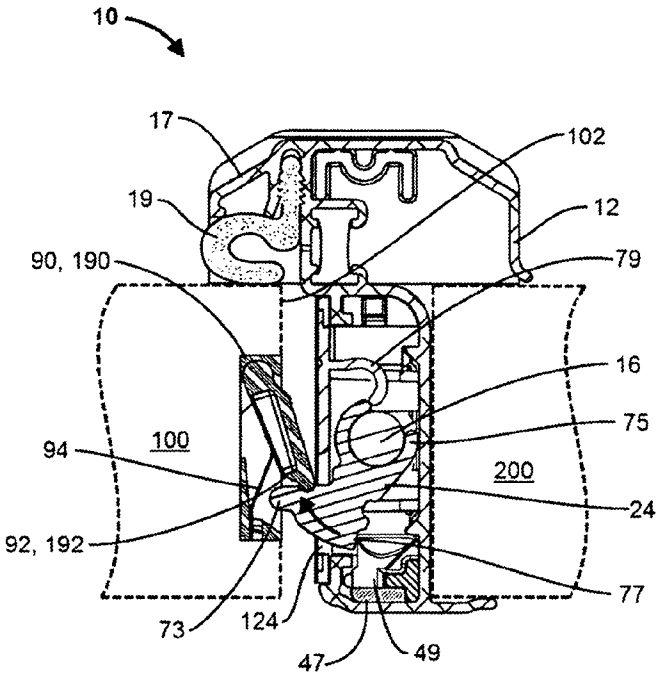
FIG. 11B is a cross-sectional view taken through the upper latch of a multi-point locking system with the latch in a locked position.
Figure 11A:
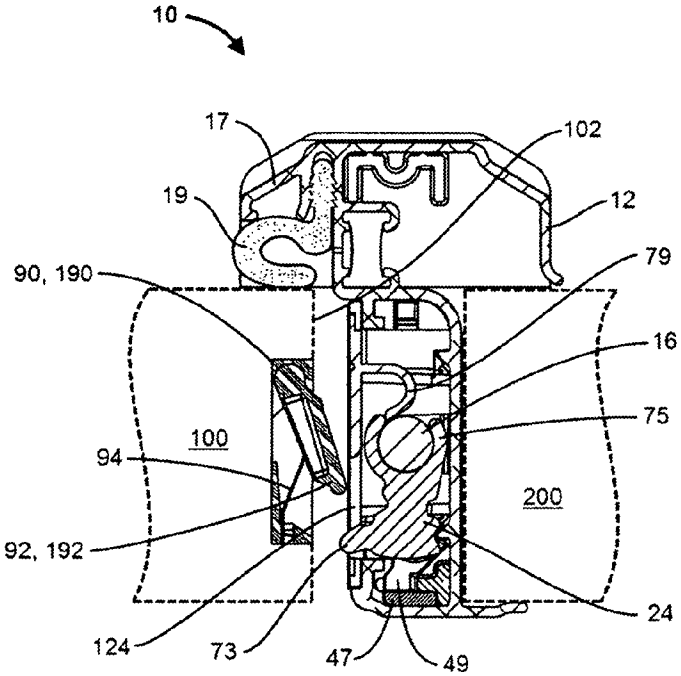
FIG. 11A is a cross-sectional view taken through the upper latch of a multi-point locking system with the latch in an unlocked position.

Operation of the multi-point latches 24, 26 is further illustrated in FIGS. 11A and 11B. In FIG. 11A, an upper latch pawl 24 is rotatably connected to an upper shoot bolt 16. Alternatively, the latch pawl can be otherwise rotatably mounted within the body 12. The latch pawl 24 is shown in a retracted unlocked position in FIG. 11A. In this position, a catch portion 73 of the latch pawl 24 is positioned proximate to an aperture 124 in the body 12. Preferably, the catch portion 73 is fully recessed within the aperture 124 or does not protrude from the aperture 124 a substantial distance when the latch pawl 24 is in its retracted position. A first cam surface 49 of a latch actuation member 47 is positioned below and proximate to the upper latch pawl 24. A resilient member 79 contacts a portion of the latch pawl 24. A resilient seal 19 provides a weather-resistant seal between the active door panel 100 and the astragal 10 when the active door panel 100 is shut. A latch keeper 90 is installed along the inside vertical edge 102 of an associated active door panel 100 such that the latch keeper 90 is proximate to the aperture 124 in the body 12 when the active door panel 100 is closed against the astragal.

Upward movement of the latch actuation member 47 causes the first cam surface 49 to contact the latch pawl 24 and forces the latch pawl 24 to pivot to the extended or locked position shown in FIG. 11B. As described above, such upward movement of the latch actuation member 47 results when a deadbolt 104 is received by the latch actuator assembly 40. In the locked position, the catch portion 73 of the latch pawl 24 outwardly extends from the aperture 124. In this locked position, retraction of the latch pawl 24 is blocked by the latch actuation member 47 which is positioned immediately behind the latch pawl 24. As can be seen by comparing FIGS. 11A and 11B, the resilient member 79 is displaced by the latch pawl 24 as the latch pawl 24 moves from its retracted unlocked position to its extended locked position. When extended, the catch portion 73 engages the latch keeper 90, thereby preventing the active door panel 100 from being opened. Retraction of the deadbolt 104 from the latch actuator assembly 40 causes downward movement of the latch actuation member 47 away from the latch pawl. Once the latch actuation member 47 is disengaged from the latch pawl 24, the resilient member 79 forces the latch pawl 24 to pivot back to the retracted or unlocked position shown in FIG. 11A. Once the deadbolt 104 and latch pawl 24 are retracted, the catch portion 73 is disengaged from the latch keeper 90, and the active door panel 100 is free to open. The lower latch pawl 26 can be configured to be moved between its locked and unlocked positions in the same manner or a substantially similar manner.

Figure 13:
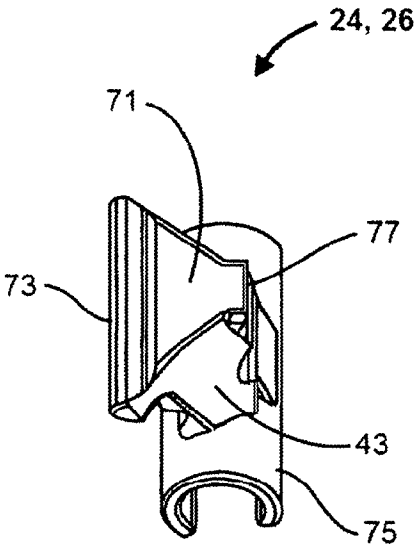
FIG. 13 is a perspective view of a latch pawl for use in a multi-point locking system.
Figure 12:
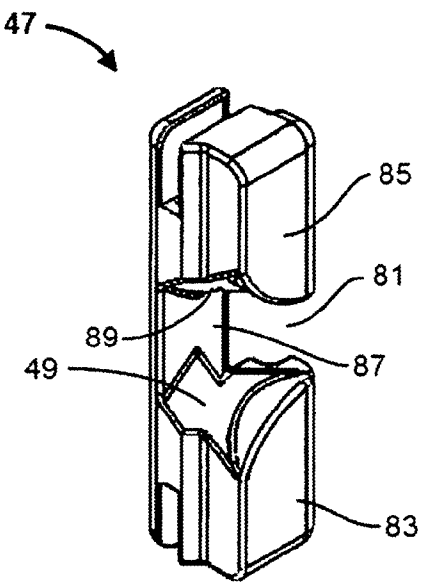
FIG. 12 is a perspective view of a latch actuation member for use in a multi-point locking system.

One embodiment of a latch actuation member 47 is shown in FIG. 12. The latch actuation member 47 can include a first portion 83 and second portion 85 connected by a coupling 87 and separated by a void 81 in between. The first portion 83 can include a first cam surface 49, and the second portion 85 can include an opposed cam surface 89. Accordingly, the first portion 83 and the second portion 85 can be mirror images of each other. The latch actuation member 47 can be configured to cooperate with a latch pawl 24, 26 like that shown in FIG. 13. The latch pawl 24, 26 can include a body 71 having a catch portion 73, a heel 77, and a pawl cam surface 43. The body 71 can be connected to a pivot mount 75.

Figure 14:
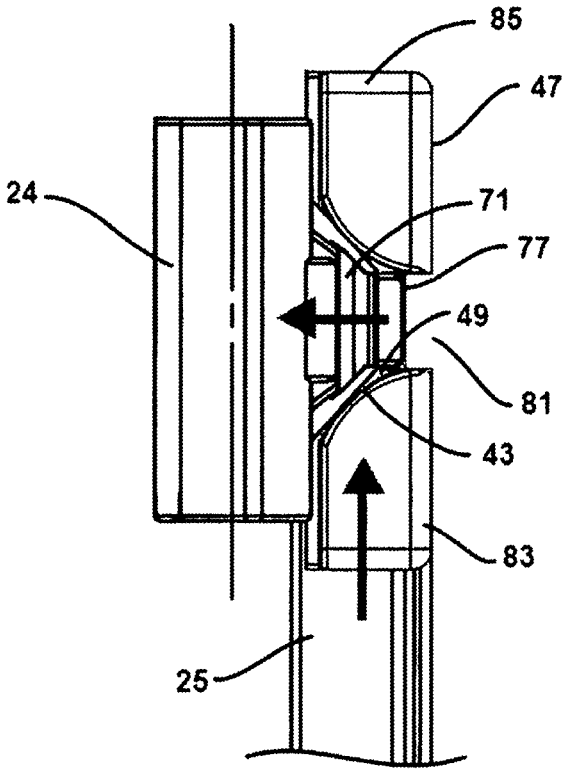
FIG. 14 is an elevation view showing a latch pawl engaged with a latch actuation member in a multi-point locking system.

FIG. 14 shows the upper latch pawl 24 engaged with the latch actuation member 47 on the upper end of the push rod 25. The latch pawl 24 is shown in a retracted position. The body 71 of the latch pawl 24 can be disposed within the void 81 between the first portion 83 and the second portion 85 of the latch actuation member 47. In this position, the pawl cam surface 43 on the pawl 24 and the first cam surface 49 on the latch actuation member 47 can be proximate to each other. Upward movement of the latch actuation member 47 can cause the first cam surface 49 to push against the pawl cam surface 43 such that the body 71 of the pawl 24 is wedged out of the void 81, and to rotate to its locked position. Conversely, downward movement of the latch actuation member 47 can realign the pawl 24 with the void 81, and can permit the body portion 71 of the pawl 24 to retract to its unlocked position within the void 81. The lower latch pawl 26 and lower latch actuation member 47 can be similarly configured. The symmetry of the first and second portions 83, 85 permits identical latch actuation members 47 to be used on both the top and bottom ends of the push rod 25.

Figure 15:
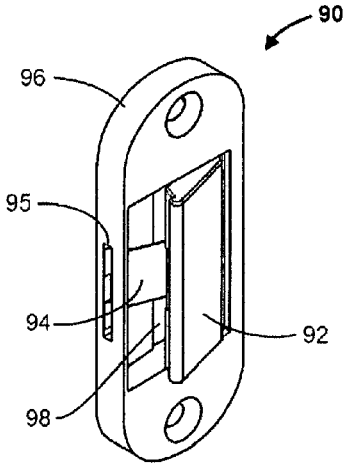
FIG. 15 is a perspective view of one embodiment of a latch keeper for use with a multi-point locking system.
Figure 16:
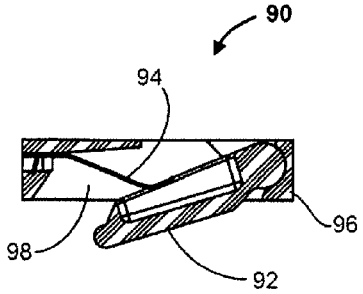
FIG. 16 is a cross-sectional view of the latch keeper shown in FIG. 15.
Figure 17:
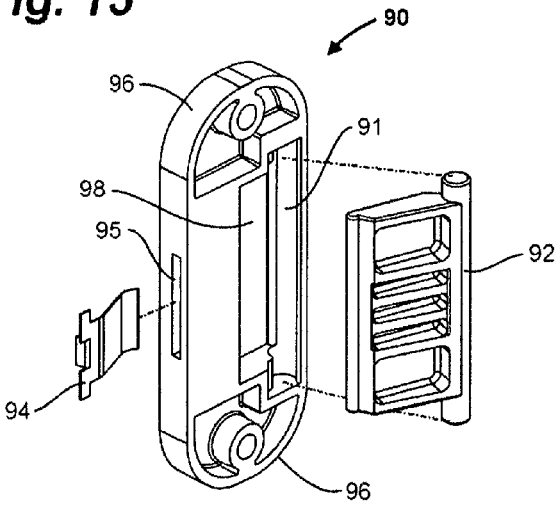
FIG. 17 is an exploded perspective view of the latch keeper shown in FIG. 15.

One embodiment of a keeper 90 for use with a multipoint locking system that includes a multi-point latch 24, 26 that pivots about a vertical axis is shown in FIGS. 15-17. In this embodiment, the keeper 90 can include a keeper base 96 with an opening 98. A keeper pawl 92 can be pivotally disposed in the opening 98 such that the keeper pawl 92 can reside within the opening 98 or can outwardly extend from the opening 98. As shown in FIG. 17, the keeper pawl 92 can snap into a mating recess 91 in the keeper base 96. A spring 94 can bias the keeper pawl 92 away from the base 96 and opening 98 and cause the keeper pawl 92 to outwardly extend from the base 96 and opening 98 in a free state. As shown in FIGS. 15-17, the spring 94 can be a leaf spring, and can be anchored in a slot 95 in the base 96.

As shown in FIGS. 11A and 11B, the spring-biased keeper pawl 92 can outwardly extend from the edge of a cooperating active door panel 100 such that the keeper pawl 92 extends across a gap between the astragal 10 and the active panel 100, and contacts the adjacent astragal 10. Because the spring 94 pushes the keeper pawl 92 toward the astragal 10, contact between the keeper pawl 92 and astragal 10 can occur though there may be substantial variation in the width of the gap between the door panel 100 and the astragal 10 from one installation to another. Accordingly, the keeper 90 can be self-adjusting. In addition, because the keeper pawl 92 can always be positioned against the astragal 10, the likelihood that the catch portion 73 of an associated latch pawl 24, 26 will engage the keeper pawl 92 when the rotating latch pawl 24, 26 extends outward from the astragal 10 is maximized. Furthermore, because the keeper pawl 92 can pivot about a vertical axis, an extended keeper pawl 92 can deflect inwardly (i.e., toward the inactive panel 200) as an active panel 100 is closed against an adjacent astragal 10. Therefore, the keeper pawl 92 will not catch on the astragal 10 as the active panel 100 closes. In addition, contact with a portion of an adjacent astragal 10 can reinforce the keeper pawl 92 when forces tending to pull the pawl 92 away from the keeper 90 are exerted on the pawl 92 by an engaged latch 24, 26.

Figure 18:
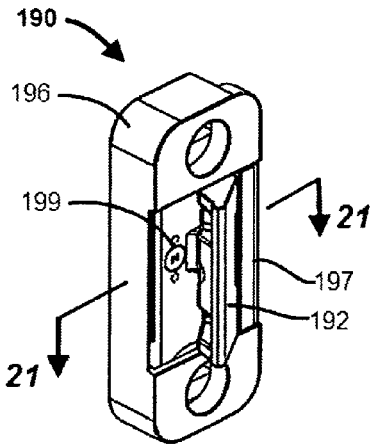
FIG. 18 is a perspective view of a second embodiment of a latch keeper for use with a multi-point locking system.
Figure 19:
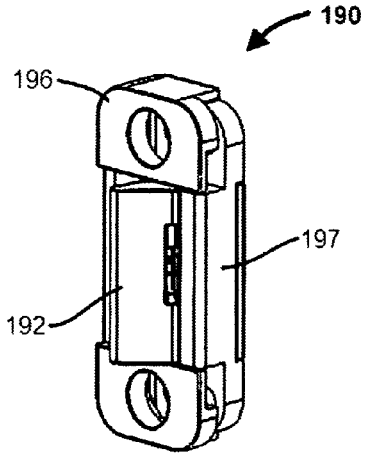
FIG. 19 is another perspective view of the second embodiment of a latch keeper shown in FIG. 18.
Figure 20:
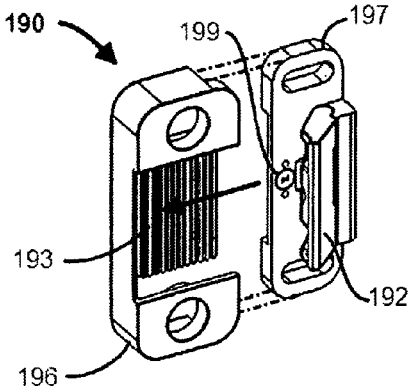
FIG. 20 is an exploded perspective view of the latch keeper shown in FIGS. 18 and 19.
Figure 21:
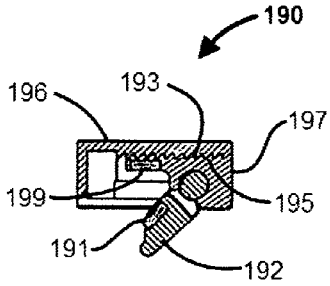
FIG. 21 is a cross sectional view of the latch keeper shown in FIGS. 18-20 taken along line 21-21 in FIG. 18.

Another embodiment of a keeper 190 for use with a multipoint locking system that includes a multi-point latch 24, 26 that pivots about a vertical axis is shown in FIGS. 18-21. In this embodiment, the keeper 190 can include a keeper base 196, a pawl support 197, and a keeper pawl 192 pivotally mounted to the pawl support 197. As shown in FIG. 20, the pawl support 197 is received in a cavity in the keeper base 196. As shown in FIGS. 18, 19 and 21, when the pawl support is received in the keeper base 196, the keeper pawl 192 outwardly and movably extends from the base 196. As seen best in FIG. 21, the pawl support 197 can include a first magnet 199 and the keeper pawl 192 can include a second magnet 191. The magnets 199, 191 are arranged such that like poles of each magnet face each other. Accordingly, the magnets 199, 191 repel each other, and bias the pivoting keeper pawl 192 away from the base 196. When the keeper 190 is installed along the non-hinged edge of a door panel 100 as shown in FIGS. 11A and 11B, the magnets 199, 191 (not shown in FIG. 11A or 11B) urge the keeper pawl 192 away from the door panel 100 and toward an opposed door panel 200. Accordingly, the keeper pawl 192 can outwardly extend from the edge of a cooperating active door panel 100 such that the keeper pawl 192 extends across a gap between the an astragal 10 and the active panel 100, and contacts the adjacent astragal 10. Because the magnets 199, 191 push the keeper pawl 92 toward the astragal 10, contact between the keeper pawl 192 and astragal 10 can occur though there may be substantial variation in the width of the gap between the door panel 100 and the astragal 10 from one installation to another. Accordingly, the keeper 190 can be self-adjusting. In addition, because the keeper pawl 192 can always be positioned against the astragal 10, the likelihood that the catch portion 73 of an associated latch pawl 24, 26 will engage the keeper pawl 192 when the rotating latch pawl 24, 26 extends outward from the astragal 10 is maximized. Furthermore, because the keeper pawl 192 can pivot about a vertical axis, an extended keeper pawl 192 can deflect inwardly (i.e., toward the inactive panel 200) as an active panel 100 is closed against an adjacent astragal 10. Therefore, the keeper pawl 192 will not catch on the astragal 10 as the active panel 100 closes. In addition, contact with a portion of an adjacent astragal 10 can reinforce the keeper pawl 192 when forces tending to pull the pawl 192 away from the keeper 190 are exerted on the pawl 192 by an engaged latch 24, 26.

The keeper 190 shown in FIGS. 18-20 also can be adjusted to optimally align the keeper pawl 192 with a latch pawl 24, 26 in an opposing astragal 10. As shown in FIG. 20, the pawl support 197 is slidably received in the keeper base 196. The depth that the pawl support 197 is inserted into the base can be selected such that the pivoting keeper pawl 192 is located at a desired position relative to the base 196. As shown in FIG. 21, the base 196 can include a first plurality of ridges 193, and the pawl support 197 includes a cooperating second plurality of ridges 195. When the pawl support 197 is inserted into the base to a desired depth and the keeper 196 is installed within a mating pocket within a door's edge, the ridges 193, 195 are pressed together, and cooperate to prevent the pawl support 197 from moving within the base 196. To adjust the alignment of the pawl support 197 in the base 196, the keeper 190 can be removed from the pocket in the door, the pawl support 197 can be repositioned within the base 196, and the keeper 190 can be reinstalled in the pocket in the door. Accordingly, the keeper 190 can be adjusted to correct any misalignment between the keeper pawl 192 and a latch pawl 24, 26 in an opposing astragal 10, and a slight lateral mislocation of a milled pocket in a door for receiving the keeper 190 can be accommodated.

Figure 22:
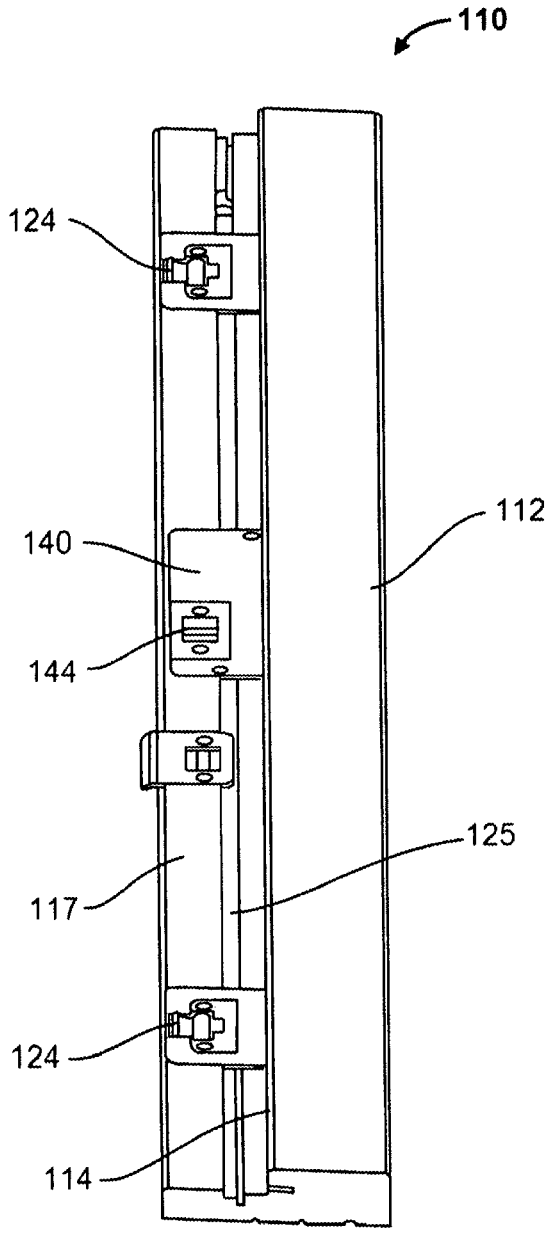
FIG. 22 is perspective view of a door frame member having a multi-point locking system.

As shown in FIG. 22, a multi-point locking system 110 that is substantially similar to that described above for a multi-point locking astragal 10 can also be incorporated into an elongated vertical doorframe member 112 for use with a single door panel installation. The vertical frame member 112 can be a side jamb like that shown in FIG. 18, or can be a mullion, for example. The vertical frame member 112 can include a stop 114 and a latch portion 117. The vertical frame member 112 can be configured such that when the non-hinged vertical edge of an associated single door panel (not shown) is closed against the stop 114, the non-hinged vertical edge of the door will be positioned immediately adjacent to the latch portion 117. As shown in FIG. 22, upper and lower pivoting latch pawls 124 and a latch actuator assembly 140 can by mounted along the latch portion 117. A channel 125 can be provided in the latch portion 117 for receiving a pushrod (not shown) that operably couples the latch actuator assembly 140 to the latch pawls 124. The latch actuator assembly 140 and latch pawls 124 can be substantially similar to the latch actuator assembly 40 and latch pawls 24, 26 described above, for example. In addition, the latch pawls 124 can cooperate with latch actuation members 47 like those described above. The locking system 110 can be configured such that when a deadbolt is received in an opening 144 in the latch actuator assembly 140, the upper and lower latch pawls 124 both outwardly pivot to their extended locking positions. Latch keepers 90 like those described above can be provided on the non-hinged vertical edge of a cooperating single door panel for engagement with the extended latch pawls 124, thereby securing the door in a closed position against the vertical frame member 112.

The above descriptions of preferred embodiments of the invention are intended to illustrate various aspects and features of the invention without limitation. Persons of ordinary skill in the art will recognize that certain changes and modifications can be made to the described embodiments without departing from the scope of the invention. For example, while the invention has been described for use with swinging door panels, a locking system according to the invention can also be applied to casement window panels and casement window frames, or the like. All such changes and modifications are intended to be within the scope of the appended claims.

What is claimed is:

1. An entryway comprising, a sill spanning a bottom of the entryway and having a lower bolt opening, a normally inactive door panel, a normally active door panel, and an astragal mounted to and extending along an unhinged edge of the normally inactive door panel, the astragal comprising:

an elongated body having opposite top and bottom;

a first shoot bolt at one end of the elongated body and being movable between a retracted position substantially withdrawn into the elongated body and an extended position projecting in an axial direction from the one end of the astragal;

a second shoot bolt at the opposite end of the elongated body and being movable between a retracted position substantially withdrawn into the elongated body and an extended position projecting in an axial direction from the opposite end of the astragal;

a seal block substantially surrounding the first shoot bolt and being movable between a non-sealing position substantially withdrawn into the elongated body and a sealing position projecting in an axial direction from the one end of the elongated body, the seal block having a bolt passage therethrough, the first shoot bolt being slidably disposed through the passage;

a shoot bolt actuator accessible on the elongated body and being movable between an unlocked position and a locked position, the shoot bolt actuator being linked through a plurality of actuator links to the first and second shoot bolts and to the seal block, the actuator links being configured upon movement of the shoot bolt actuator from its unlocked position toward its locked position to drive the seal block toward the sealing position until the seal block engages against the sill, to drive the first shoot bolt from the retracted position toward the extended position, and to drive the second shoot bolt from the retracted position toward the extended position;

a first spring configured to bias the first shoot bolt; and a second spring configured to bias the seal block, wherein the second spring has a first length when the seal block is in the non-sealing position and the shoot bolt actuator is in the unlocked position, and wherein the second spring has a second length when the seal block is in the sealing position engaged with the sill and the shoot bolt actuator is in the locked position, the first length being longer than the second length.

2. The entryway according to claim 1 wherein the shoot bolt actuator is configured to move both the first shoot bolt and the second shoot bolt from their retracted positions toward their extended positions substantially simultaneously.

3. The entryway according to claim 1 further comprising a plurality of spaced latch pawls disposed in the elongated body, each latch pawl being movable between an unlocked position substantially contained within the elongated body and a locked position projecting from the elongated body in a direction away from the unhinged edge of the inactive door panel.

4. The entryway according to claim 3 further comprising a latch actuator configured to move the spaced latch pawls between their unlocked positions and their locked positions substantially simultaneously.

5. The entryway according to claim 3 wherein the latch actuator includes a base having an opening configure to receive a deadbolt, the latch actuator is configured to move the spaced latch pawls from their unlocked positions to their locked positions as the deadbolt is received in the opening.

6. The entryway according to claim 3 wherein each latch pawl pivots about a vertical axis as the latch pawls move between their locked and unlocked positions.

7. The entryway according to claim 3 further comprising a plurality of latch keepers affixed along a non-hinged vertical edge of the normally active door panel such that each latch keeper vertically aligns with one of the latch pawls, and wherein each latch keeper includes a pivoting keeper pawl that outwardly extends from the non-hinged vertical edge of the active door panel.

8. The entryway according to claim 1, wherein the actuator links are further configured such that continued movement of the shoot bolt actuator to its locked position compresses the first spring to apply a progressively increasing biasing force to the first shoot bolt, thereby biasing the first shoot bolt into engagement within the lower bolt opening.

9. The entryway according to claim 1, wherein the first spring and the second spring are spaced apart along the body and coaxial with one another.

10. The entryway according to claim 1, further comprising a resilient seal attached to a lower end of the seal block.

* * * * *